United States Patent [19]

Kurrasch

[11] Patent Number: 4,619,208

[45] Date of Patent: Oct. 28, 1986

[54] WORK SURFACE HEIGHT ADJUSTMENT MECHANISM

[75] Inventor: Andrew J. Kurrasch, Saugatuck, Mich.

[73] Assignee: Herman Miller, Inc., Zeeland, Mich.

[21] Appl. No.: 686,846

[22] Filed: Dec. 27, 1984

[51] Int. Cl.[4] ..... A47B 9/00

[52] U.S. Cl. ..... 108/144; 108/20; 108/106; 108/147

[58] Field of Search ..... 248/157; 108/20, 147, 108/144, 106; 254/103; 312/247, 246, 312

[56] References Cited

U.S. PATENT DOCUMENTS

| | | | |
|---|---|---|---|
| 1,642,258 | 9/1927 | May | 248/404 |
| 1,694,243 | 12/1928 | Wilford | 248/404 |
| 2,536,511 | 1/1951 | Megies | 108/67 |
| 2,694,612 | 11/1954 | Morrow | 312/312 X |
| 3,300,791 | 1/1967 | Carmack | 108/147 |
| 3,304,892 | 2/1967 | Bengtson | 108/136 |
| 3,411,464 | 11/1968 | MacKay | 108/136 |
| 3,682,108 | 8/1972 | Perminov | 108/6 |
| 3,729,113 | 4/1973 | Łopatka | 312/247 X |
| 3,820,176 | 6/1974 | Feiertag | 108/1 |
| 3,890,907 | 6/1975 | Peterson | 108/136 |
| 3,905,311 | 9/1975 | Carpentier | 108/136 |
| 4,130,069 | 12/1978 | Evans et al. | 108/144 |
| 4,315,466 | 2/1982 | Boerigter | 108/147 |
| 4,381,714 | 5/1983 | Henneberg | 108/147 |

FOREIGN PATENT DOCUMENTS

| | | | |
|---|---|---|---|
| 7388 | 3/1956 | Fed. Rep. of Germany | 108/147 |

*Primary Examiner*—James T. McCall

*Attorney, Agent, or Firm*—Varnum, Riddering, Schmidt & Howlett

[57] ABSTRACT

A mechanism for adjusting the height of a work surface (12) includes left- and right-side cable lift mechanisms (16, 18) coupled to a central drive mechanism (20) through cables (96). Each cable lift mechanism (16, 18) includes a hanger clip (22) engaging wall panel slots (15), a mounting plate (38) removably suspended from the hanger clip (22) and a vertically movable extrusion (74) guided along the plate (38) and having pulleys (88) engaging one of the cables (96) to support the work surface (12). Antidislodgment latches (50, 60) prevent accidental dislodgment of the mounting plate (38) and clip (22). One embodiment of the central drive mechanism (20) includes a motor-driven screw (134) and a forward slide block (114) positioned within an elongated channel (110) and mounting a slidable yoke (122) securing ends of the cables (96). The slide block (114) bears against a nut (146) captured within the channel (110) and threadably received on the screw (134). Axial movement of the nut (146) causes corresponding movement of the slide block (114) and yoke (122), thereby exerting forces through the cables (96) to selectively raise or lower the extrusion (74) and work surface (12).

26 Claims, 11 Drawing Figures

WORK SURFACE HEIGHT ADJUSTMENT MECHANISM

DESCRIPTION

1. Technical Field

The invention relates to height adjustment arrangements and, more particularly, to mechanisms employing pulley and cable systems for automatically adjusting the height of a work surface.

2. Background Art

In the modern office or industrial environment, it is common to provide work stations having various types of functional furniture components. These furniture components can include work surfaces utilized for numerous purposes, including drafting and support of office equipment such as typewriters and computer components.

It is desirable for these work stations and other similar types of functional furniture arrangements to have height adjustment capability of the work surfaces so as to accommodate the needs of specific users. This adjustment capability is especially important in work environments where the work surfaces are utilized for various functions or where two or more people use the work surfaces at different times, such as when multiple employment shifts are in operation.

It is known to employ pulley and cable systems in height adjustment mechanisms for various types of work surfaces. For example, the Perminov U.S. Pat. No. 3,682,108 issued Aug. 8, 1972, discloses a drawing machine in which a drawing work surface is supported on a base through telescoping leg tubes. A pulley and cable system is housed within the leg tubes as part of an assembly to adjust the height of the drawing machine work surface.

Work surfaces employed in work stations can also be mounted to wall panels and the like, thereby eliminating the need for supporting legs. These types of work surfaces are often used in modular office systems, where the work stations and wall panels themselves can be configured as required to efficiently meet specific office needs for space and equipment. It is known to employ pulley and cable systems in height adjustment mechanisms for such work surfaces. For example, the Bengtson U.S. Pat. No. 3,304,892 issued Feb. 21, 1967, discloses a cantilevered work surface supported on wall brackets through a height adjustment mechanism. The adjustment mechanism includes a crank arm and a pulley and cable system wherein the cables are secured at one end to a spring and at another end to work surface mounting brackets.

Various other types of height adjustment mechanisms utilizing automated systems for adjusting the work surface height are also known. For example, in the Boerigter U.S. Pat. No. 4,315,466 issued Feb. 16, 1982, a height adjustable table includes a work surface mounted on telescoping side legs. The telescoping side legs are adjusted in height through an electrically-driven hydraulic pulley and cable system.

When providing a height adjustment mechanism for a work surface, several potential problems must be considered. For example, height adjustment mechanisms employing pulley and cable systems often utilize multiple lift positions where the systems exert supporting forces directly or indirectly on the work surface. If the work surface load is unbalanced, such as when relatively heavy objects are on the work surface, the loading on the cable systems may also be unbalanced, resulting in poor height adjustment performance or potential binding of mechanism components.

In addition, if the adjustment mechanism is automated and driven, for example, by a motor or similar arrangement, motor or gearing vibrations may be transferred to the work surface. Still further, height adjustment mechanisms typically include components which bear at least a partial weight of the work surface. If load bearing occurs at structural positions of relative weakness, such as along screw threads or similar coupling positions, extensive wear and damage to the mechanism components can result.

When a work surface is mounted to wall panels or the like, the height adjustment mechanism itself can comprise part of the supporting structure. If the work surface is utilized in a wall panel office system, it is important that the work surface and adjustment mechanism can be mounted and removed from the wall panels in a relatively efficient manner. However, it is also important that accidental dislodgment of the work surface and adjustment mechanism cannot easily occur.

Finally, almost all types of height adjustment mechanisms utilize moving components accessible to a user. With adjustment mechanisms employing automated assemblies, such as motor-driven pulley and cable systems, it is important to avoid accidental activation of the adjustment mechanism.

SUMMARY OF THE INVENTION

In accordance with the invention, a mechanism for automatically adjusting the height of a work surface includes left- and right-side cable lift mechanisms, a central drive mechanism and cable means operatively coupling the lift mechanisms to the central drive mechanism. The lift mechanisms each include mounting means to mount the corresponding lift mechanism to a wall panel or similar support. Lift support means for mounting the work surface are vertically movable relative to the mounting means. Support pulley means are secured to the lift support means and engage the cable means to support the work surface.

The central drive mechanism includes central support means to mount the drive mechanism to the work surface. The drive mechanism also includes force generating means, in addition to means connected to the cable means and the force generating means to exert forces on each of the lift support means in response to forces generated by the force generating means, thus selectively raising or lowering the work surface.

With respect to the left- and right-side cable lift mechanisms, the mounting means include a hanger clip with projecting means engaging openings in the wall panel. First antidislodgment means are pivotally coupled to the clip and engageable with at least one other opening in the wall panel. The antidislodgment means prevent dislodgment of the clip from the wall panel when the projecting means is engaged with the wall panel opening.

The mounting means also include a mounting plate removably suspended from the hanger clip. The plate includes a surface bearing against the first antidislodgment means to maintain engagement with the other wall panel opening.

The mounting means can also include second antidislodgment means pivotally mounted to the mounting plate and engageable with a slot in the hanger clip after suspension of the plate from the clip. The second antidislodgment means thereby prevents accidental dislodgment of the plate.

The mounting means can also include guide means engaging the lift support means to maintain vertical alignment of the support means during height adjustment of the work surface. In addition, a support casting is provided which mounts the work surface and includes a vertical surface mating with a bell-shaped portion of the mounting plate to assist in guiding the mounting plate into engagement with the clip.

The lift support means includes an extrusion having projecting portions forming a trackway. The stationary mounting plate can include at least one guide wheel coupled to the plate and engaging the trackway to maintain vertical alignment of the extrusion. The lift support pulley means includes upper and lower pulleys rotatably coupled to the extrusion, and the cable means includes at least one cable engaging the upper and lower pulleys and secured at one end to the mounting plate.

The height adjustment mechanism can also include switch means to manually activate the force generating means. The switch means are located adjacent the left- and right-side cable lift mechanisms and are connected in a series configuration to require an operator to use two hands for activation. In addition, limit switch means can be mounted to the central drive mechanism to deactivate the force generating means when the work surface height attains predetermined upper or lower limits.

With respect to the central drive mechanism, the force generating means can include an elongated member rotatably coupled to the central support means, with means provided for selectively rotating the member. Force translation means are axially received on the elongated member to translate rotational forces into linear forces. The means connected to the cable means and to the force generating means includes cable securing means connected to the cable means and the force translation means so as to exert forces on a lift support means in response to rotation of the elongated member, thereby selectively raising or lowering the work surface.

The cable securing means are slidably mounted to the central support means and bear against the force translation means. Thus, axial movement of the force translation means in one direction correspondingly moves the cable securing means along the central support means to exert forces on each of the lift support means and raise the work surface. Axial movement of the force translation means in an opposing direction causes the cable securing means to also move in the opposing direction. This movement partially releases forces exerted on each of the lift support means through the cable means so as to lower the work surface.

The force translation means includes a nut threadably received on the elongated member. The cable securing means includes a forward slide block slidable along the axis of the member and having at least one surface bearing against one surface of the nut. In addition, the forward slide block is at least partially laterally pivotable relative to the elongated member. One surface of the forward slide block and one surface of the nut are configured so as maintain load bearing forces exerted on the nut in the axial direction of the elongated member.

The central support means include elongated channel means to capture the nut so as to prevent rotation in response to rotation of the elongated member. The forward slide block is slidably secured within the channel means, and the cable securing means includes a yoke plate connected to the slide block above the channel means. The securing means also includes means extending laterally from each side of the plate to secure the cable means, with means slidably secured within the channel means rearwardly of the nut to maintain alignment of the yoke plate relative to the channel means.

The channel means can include a forwardly-projecting U-shaped channel having inwardly-turned return legs. The forward slide block and the nut are captured under the return legs. In addition, the elongated member extends axially through the channel means and is rotatably coupled to a front portion of the channel means. A thrust bearing is received on the front portion of the elongated member to bear loading forces resulting from forces exerted through the cable means.

The adjustment mechanism also includes central pulley means rotatably secured to the channel means to provide engaging support of the cable means. In addition, resilient means are mounted to the central support means to isolate vibratory motion of the means for rotating the elongated member from the work surface.

BRIEF DESCRIPTION OF THE DRAWINGS

The invention will now be described with reference to the drawings in which.

DETAILED DESCRIPTION

Figure 1:
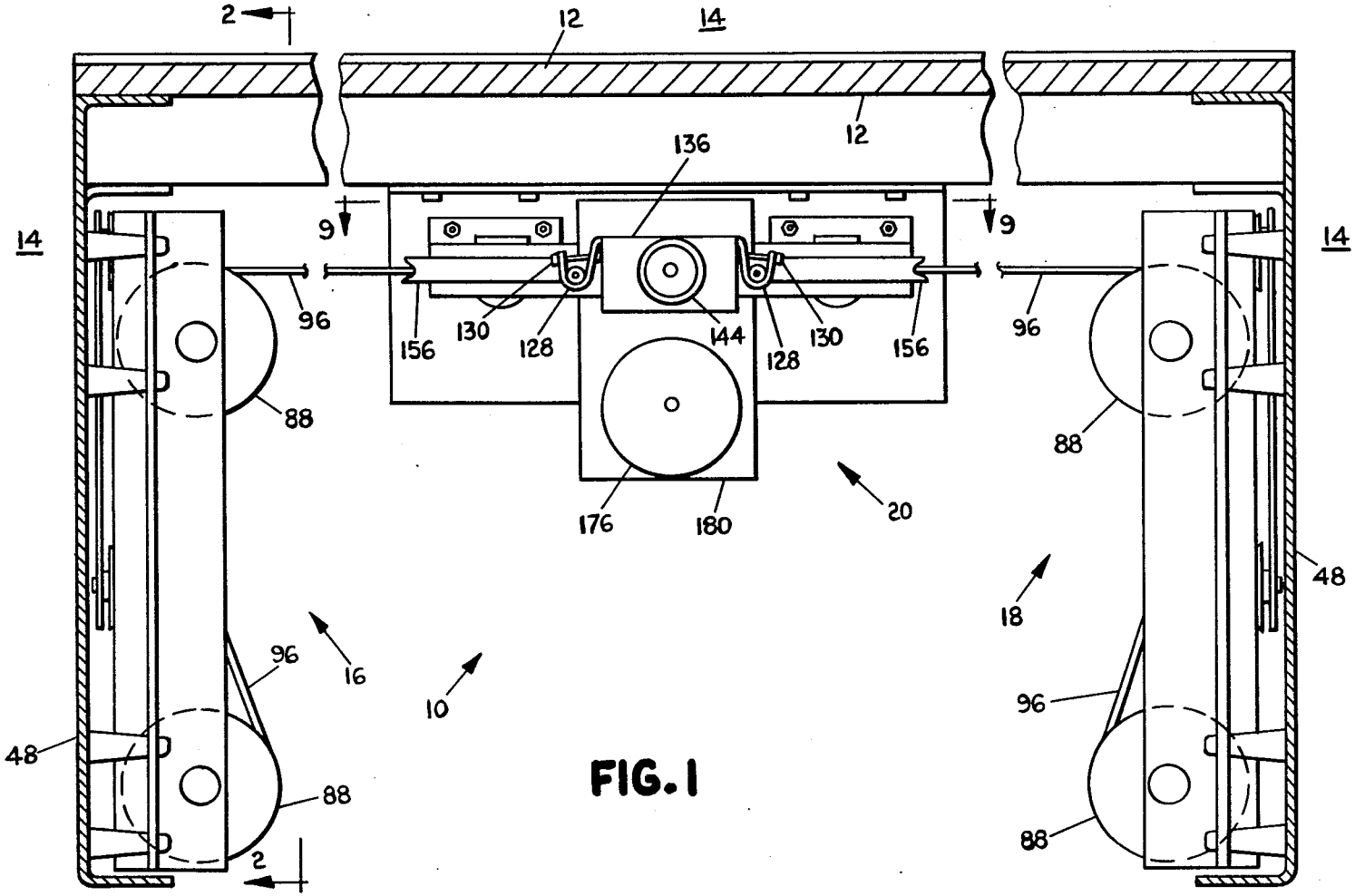
FIG. 1 is an elevational view of a work surface height adjustment mechanism in accordance with the invention, and with a portion of the work surface and support casting cut away.

The principles of the invention are disclosed, by way of example, in a work station 10 having a work surface 12 as depicted in FIG. 1. The height of the work surface 12 can be automatically adjusted to suit the particular needs of the user. Specifically, the work surface 12 (partially cut away in FIG. 1) is adapted to be mounted to rear wall panels 14. The panels 14 can comprise a stationary wall or, alternatively, can include separate and movable wall panels such as those used for assembly of modular office systems and the like.

To provide a means for automatically adjusting the height of the work surface 12, the work station 10 includes a height adjustment mechanism comprising three portions, namely a left-side cable lift mechanism 16, a similar right-side cable lift mechanism 18 and a central drive mechanism 20. Only the left-side lift mechanism 16 and central drive mechanism 20 will be described in detail, since the right-side lift mechanism 18 is essentially identical to mechanism 16.

Figure 5:
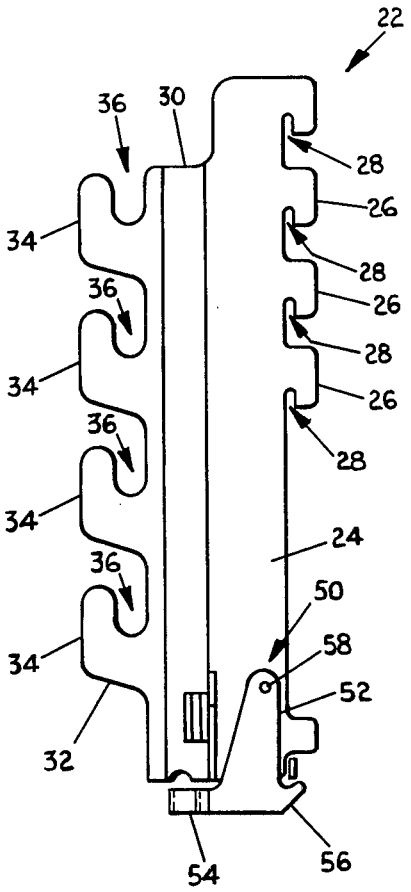
FIG. 5 is a side view separately showing the hanger clip and one of the antidislodgment latches.

The mounting of the work surface 12 to the wall panels 14 and the left-side lift mechanism 16 will now be described with respect to FIGS. 2–8. The principal connection between the wall panels 14 and the work station 10 is provided through a hanger clip 22. One hanger clip 22 is utilized with the left-side cable mechanism 16, while a second hanger clip 22 is employed with the right-side lift mechanism 18. As shown in FIG. 5, each hanger clip 22 comprises an elongated rear portion 24 having downwardly-projecting flanges 26 forming slots 28. The flanges 26 are engaged within slots or holes 15 (FIG. 3) formed within the wall panels 14 so that each hanger clip 22 is essentially suspended in a cantilevered manner.

Figure 2:
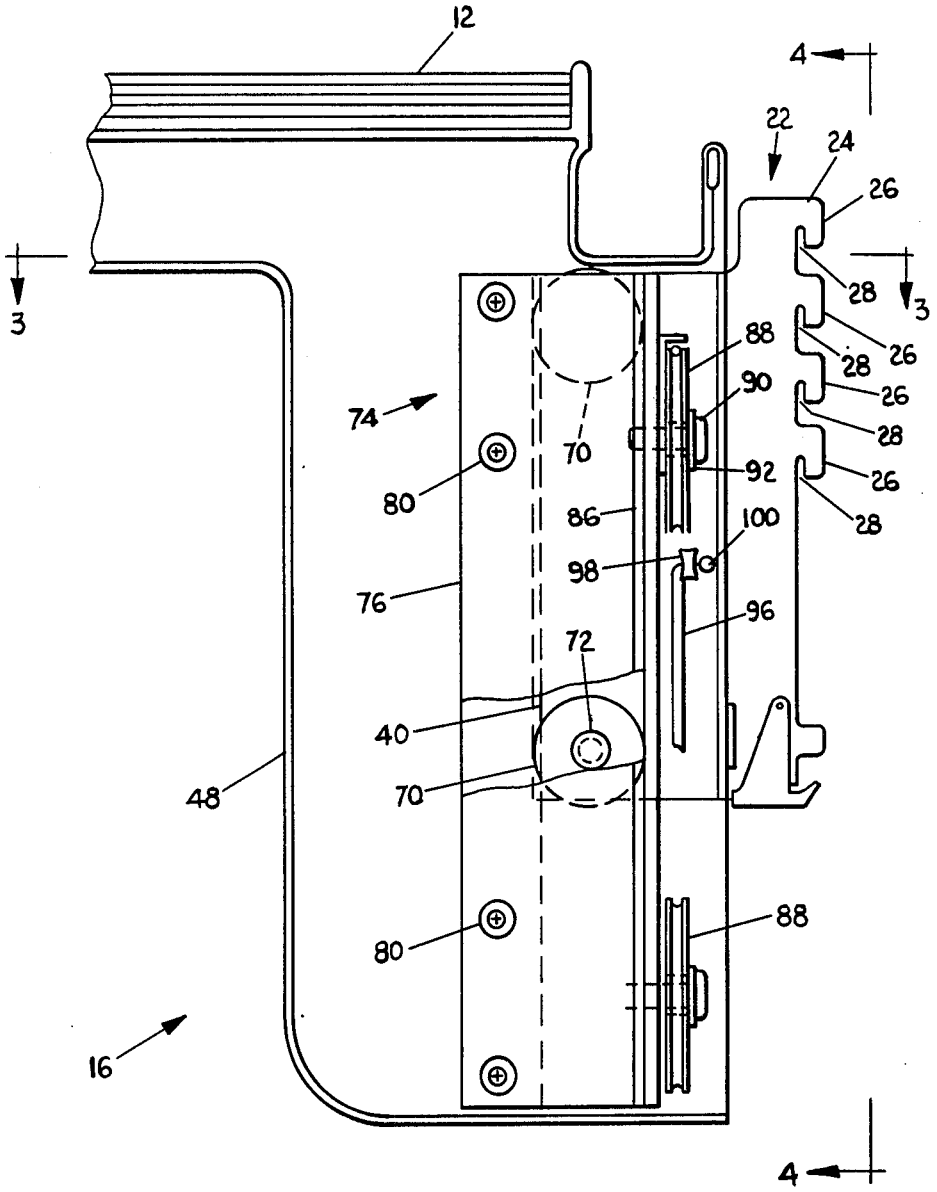
FIG. 2 is a sectional side view of the left-side lift mechanism of the height adjustment mechanism taken along lines 2—2 of FIG. 1.
Figure 3:
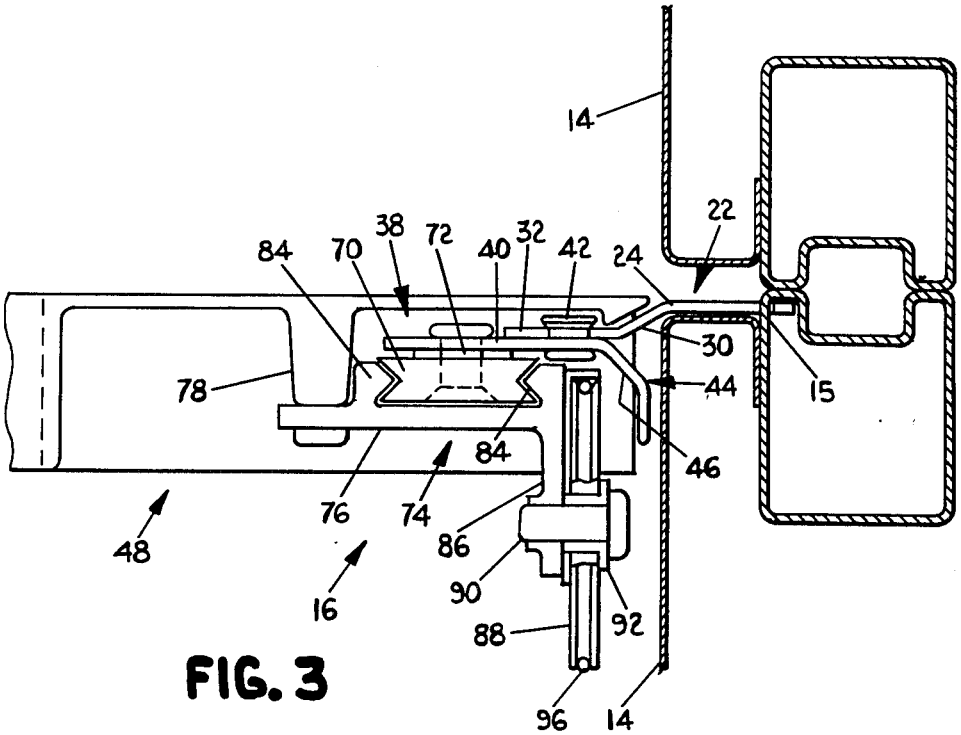
FIG. 3 is a sectional top view of the left-side lift mechanism taken along lines 3—3 of FIG. 2 and showing connection of the hanger clip to the wall panels.
Figure 4:
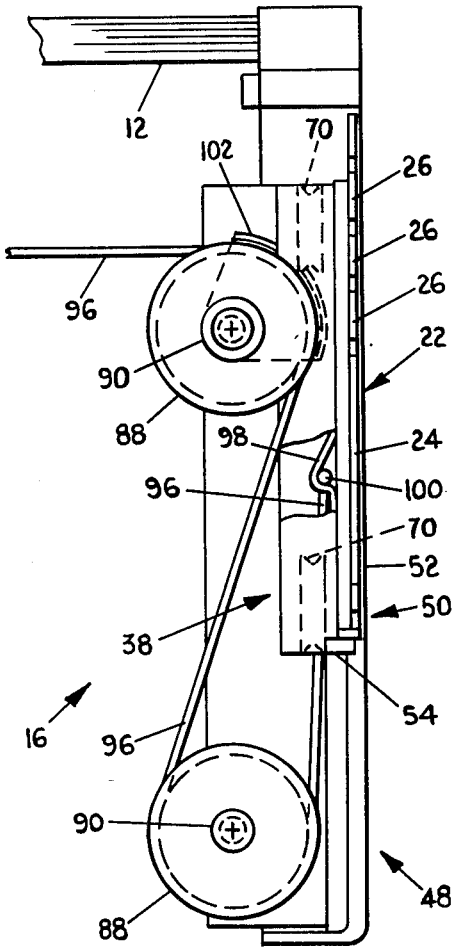
FIG. 4 is a rear view of the left-side lift mechanism taken along lines 4—4 of FIG. 2.

The elongated rear portion 24 is integrally connected through an angled segment 30 to an elongated front portion 32 having upwardly-extending flanges 34 forming slots 36 open at the top portions thereof. For purposes of securing moving components of the lift mechanism 16 to the corresponding hanger clip 22, a mounting plate 38 is secured to the hanger clip 22 as shown in FIGS. 2, 3 and 4. The mounting plate 38 includes a straight portion 40 having a series of vertically-aligned rivets 42. The rivets 42 extend outwardly on one side of the mounting plate 38 a distance sufficient so as to engage the slots 36 formed in the elongated front portion 32 of hanger clip 22.

The mounting plate 38 also includes an angled portion 44 integrally connected to the straight portion 40. The angled portion 44 is angled in a manner so that it mates with a corresponding end portion 46 of a support casting 48 which directly mounts the work surface 12. The angled portion 44 thus assists in guiding the mounting plate 38 and corresponding rivets 42 into engagement with the slots 36 formed in the hanger clip 22.

Figure 6:
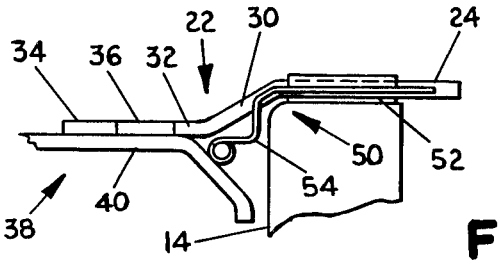
FIG. 6 is a plan view separately showing the connection of the antidislodgment latch depicted in FIG. 5 to the hanger clip and its association with the mounting plate of the left-side lift mechanism.

The work station 10 can be assembled by first suspending the hanger clips 22 from the wall panels 14, with flanges 26 engaging slots 15. The mounting plate 38 is then secured to the hanger clip 22 with rivets 42 engaging clip slots 36. However, if no other connection means are employed, the hanger clip 22 is not protected against accidental dislodgment by upward movement relative to the wall panels 14. To ensure that the structure remains relatively rigid and such dislodgment cannot easily occur, there is shown in FIGS. 5 and 6 a first antidislodgment latch 50. The antidislodgment latch 50 includes an elongated curved portion 52 having a pivot connection 58 on one side of the elongated rear portion 24 of hanger clip 22. At the lower portion of the first latch 50, a forwardly-extending flange 54 is offset and terminates in a looped portion as shown in cross-section in FIG. 6. The latch 50 also includes a lower rearwardly-extending flange 56 angled upwardly as shown in FIG. 5.

With the latch 50 pivotably connected to the hanger clip 22, connection of the mounting plate 38 to the hanger clip 22 will cause an exertion of forces on the forwardly-extending flange 54 so as to maintain the rearwardly-extending flange 56 within a slot (not shown) in the wall panels 14. Accordingly, the hanger clip 22 is thus prevented from accidental dislodgment from the wall panels 14 through upward movement relative thereto.

Figure 7:
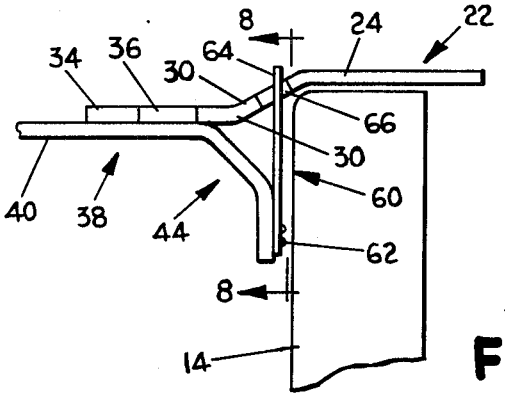
FIG. 7 is a partial plan view showing connection of the second antidislodgment latch to the hanger clip and mounting plate.
Figure 8:
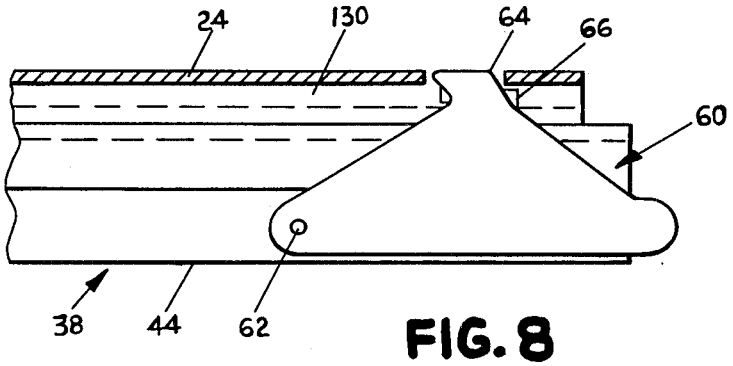
FIG. 8 is a side view of the second antidislodgment latch taken along lines 8—8 of FIG. 7.

To prevent dislodgment of the mounting plate 38 from the hanger clip 22 through accidental upward movement of the rivets 42 relative to the slots 36, a second anti-dislodgment latch 60 is also provided as shown in FIGS. 7 and 8. The second latch 60 is pivotably mounted to the mounting plate 38 at pivot connection 62. The latch 60 includes a flange 64 extending into a slot 66 within the angled segment 30 of hanger clip 22 after the rivets 42 are secured within the slots 36. Engagement of the flange 64 within slot 66 thereby prevents upward movement of the mounting plate 38 relative to the hanger clip 22. The clip 22, plate 38 and latches 50, 60 can be characterized as a mounting means to mount the corresponding lift mechanism 16 or 18 to the wall panels 14.

Referring again to FIGS. 2, 3 and 4, a pair of vertically-aligned upper and lower guide wheels 70 are rotatably mounted to the straight portion 40 of mounting plate 38 by means of conventional axles 72. There is also shown an elongated extrusion 74 having a forwardly-projecting vertical portion 76 rigidly secured to the support casting 48 by means of a series of vertically-aligned lugs 78. The lugs 78 are integral with the main body of the support casting 48 and secured within apertures in the vertical portion 76 of extrusion 74 by means of screws 80 or comparable connecting means.

As specifically shown in FIG. 3, extending laterally from the forwardly-projecting vertical portion 76 of extrusion 74 are a pair of guides 84 having a configuration conforming to the periphery of the guide wheels 70 and thereby forming a guide wheel track. The guide wheels 70 and guides 84 thus provide a means for maintaining alignment during vertical movement of the extrusion 74.

The extrusion 74 also includes a rear vertically-disposed transverse portion 86 perpendicular to the forwardly-projecting portion 76. Mounted to the transverse portion 86 is a pair of vertically-aligned upper and lower pulleys 88. As shown in a cut-away portion of FIG. 3, each of the pulleys 88 is rotatably mounted to the transverse portion 86 by means of a conventional axle pin 90 and bushing 92.

Wound around each of the pulleys 88 is a conventional cable 96. As particularly shown in FIG. 4, one end of the cable 96 is secured in a stationary manner to a hook 98 formed on one side of the mounting plate 38. This securing connection can be made in any conventional manner, such as by use of a securing ball 100 attached to the end of cable 96 and sized such that it cannot slide through the slot formed within hook 98. To maintain the cable 96 on the pulleys 88, cable guards 102 (depicted only on upper pulley 88) can be mounted to extrusion 74 adjacent one or both of the pulleys 88.

The extrusion 74 and support casting 48 can be characterized as a vertically movable lift support means for mounting the work surface 12. Correspondingly, the pulleys 88 comprise a support pulley means rotatably secured to the lift support means and engaging the cable 96.

The right-side cable lift mechanism 18 is essentially a mirror image of the aforedescribed left-side cable lift mechanism 16 and includes functionally and structurally identical elements to those described above with respect to the lift mechanism 16. In FIG. 1, elements of right-side mechanism 18 are like-numbered with functionally identical elements of left-side mechanism 16.

As also shown in FIG. 1, the cables 96 from the left-side lift mechanism 16 and right-side lift mechanism 18 each extend under the work surface 12 and towards opposing sides of the central drive mechanism 20. The central drive mechanism 20 will now be described with respect to FIGS. 9, 10 and 11.

Figure 11:
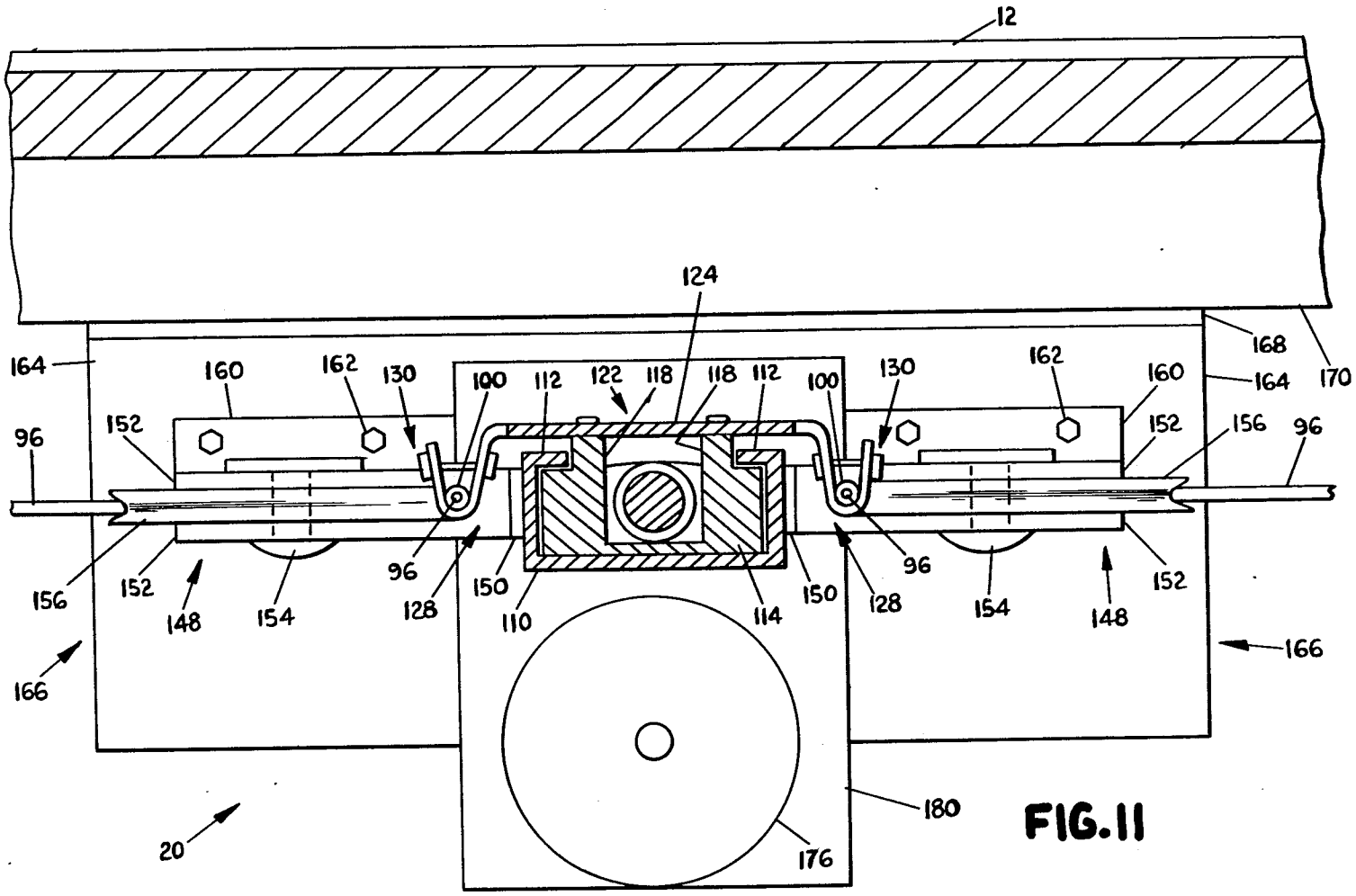
FIG. 11 is a sectional front view of the central drive mechanism taken along lines 11—11 of FIG. 10.

As shown particularly in FIG. 11, the central drive mechanism 20 includes a forwardly-projecting and horizontally-disposed elongated channel 110. The channel 110 has a U-shaped configuration with a pair of inwardly-turned return legs 112. The inner spacial area of the channel 110 forms a trackway for a pair of slide blocks comprising a forward slide block 114 and a rear slide block 116. Each of the slide blocks 114 and 116 has a substantially U-shaped cross-sectional configuration, with the main body of each retained within the trackway of channel 110. Each of the blocks 114, 116 also includes a pair of upstanding members 118 extending above the return legs 112.

Figure 9:
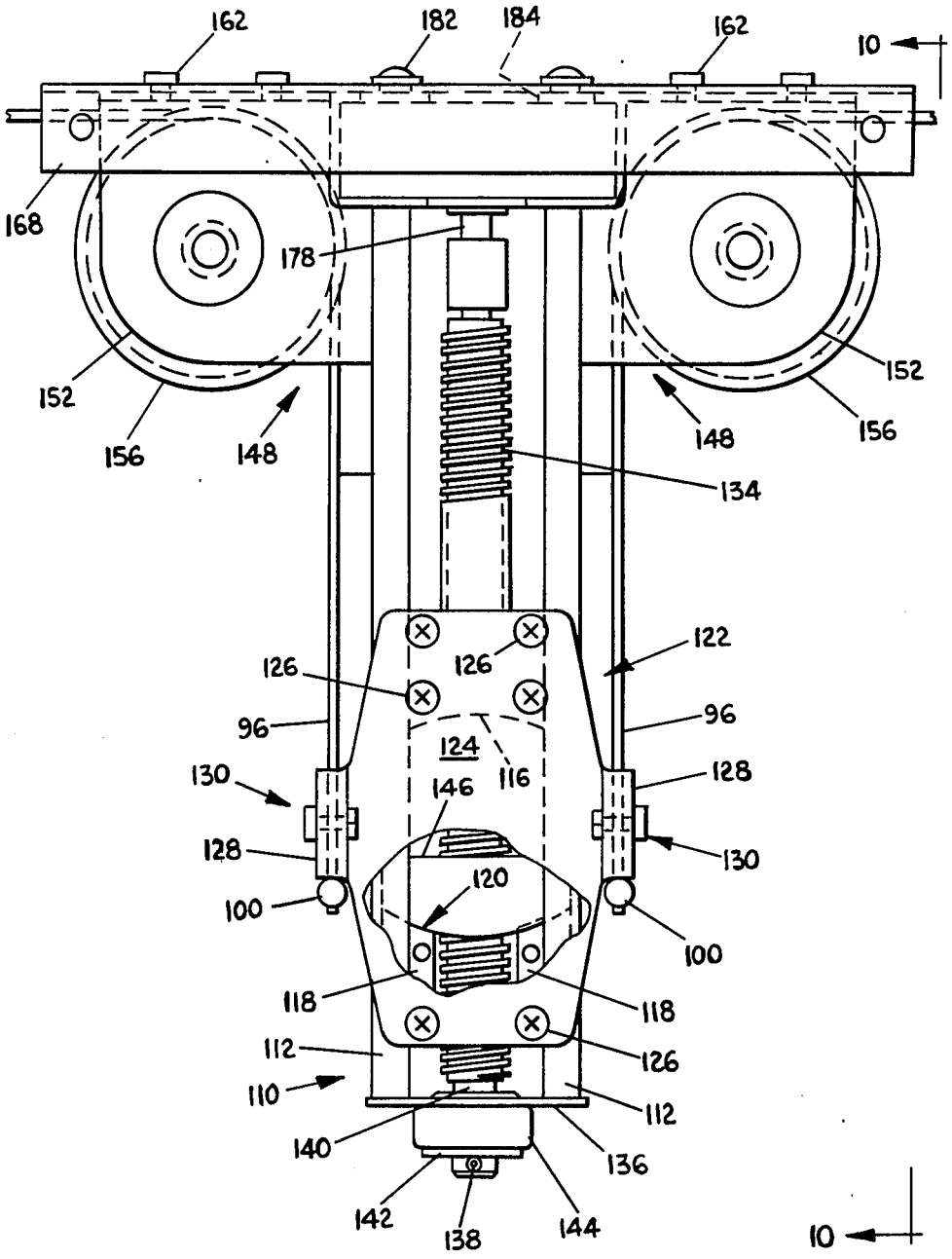
FIG. 9 is a sectional top view of the central drive mechanism of the height adjustment mechanism taken along lines 9—9 of FIG. 1.

As particularly shown in FIG. 9, the rear surface 120 of the forward slide block 114 is rounded so as to essentially form a spherical surface, the purpose of which is described in subsequent paragraphs herein. The configuration of the rear slide block 116 is substantially identical to that of the forward slide block 114.

Referring again to FIGS. 9, 10 and 11, the central drive mechanism 20 also includes a yoke 122 having a yoke plate 124 centered above the elongated channel 110 and secured to the upstanding members 118 of the blocks 114 and 116 by means of screws 126 or similar connecting means. Extending outwardly from each lateral side of the yoke plate 124 are a pair of integrally connected and substantially U-shaped cable support saddles 128. Each of the saddles 128 secures a corresponding one of the cables 96 extending from the left-side lift mechanism 16 and right-side mechanism 18. The cables 96 can be secured within the saddles 128 by means of securing balls 100 attached in any suitable manner to the ends of the cables 96. In addition, to prevent the ends of cables 96 from any substantial vertical movement, nut and bolt assemblies 130 or similar securing means can be connected through apertures in legs of the saddles 128 above the cables 100. The slide blocks 114, 116 and yoke 122 can be characterized as a cable securing means connecting the cables 96 and slidably mounted to channel 110.

As primarily shown in FIG. 9, a threaded screw 134 extends axially through the inner spacial area of the elongated channel 110. At the forward end of channel 110, a forward shaft portion 140 of the screw 134 is rotatably coupled through an aperture within an end plate 136 secured in any conventional manner to the forward end surface of channel 110. The threaded screw 134 is secured at its forward portion 140 by means of a pin 138 or similar securing means. Received on the forward shaft portion 140 of screw 134 between pin 138 and end plate 136 is a washer plate 142 and a thrust bearing 144.

A nut 146 is threadably received on the threaded portion of screw 134 immediately rearward of the forward slide block 114 and in front of the rear slide block 116. The nut 146 is of sufficient dimensions so that it is captured under the return legs 112 within the inner spacial area of the elongated channel 110. As shown in the cut-out portion of FIG. 9, the front surface of the nut 146 is rounded with a configuration which substantially mates with the rear surface 120 of the forward slide block 114.

Figure 10:
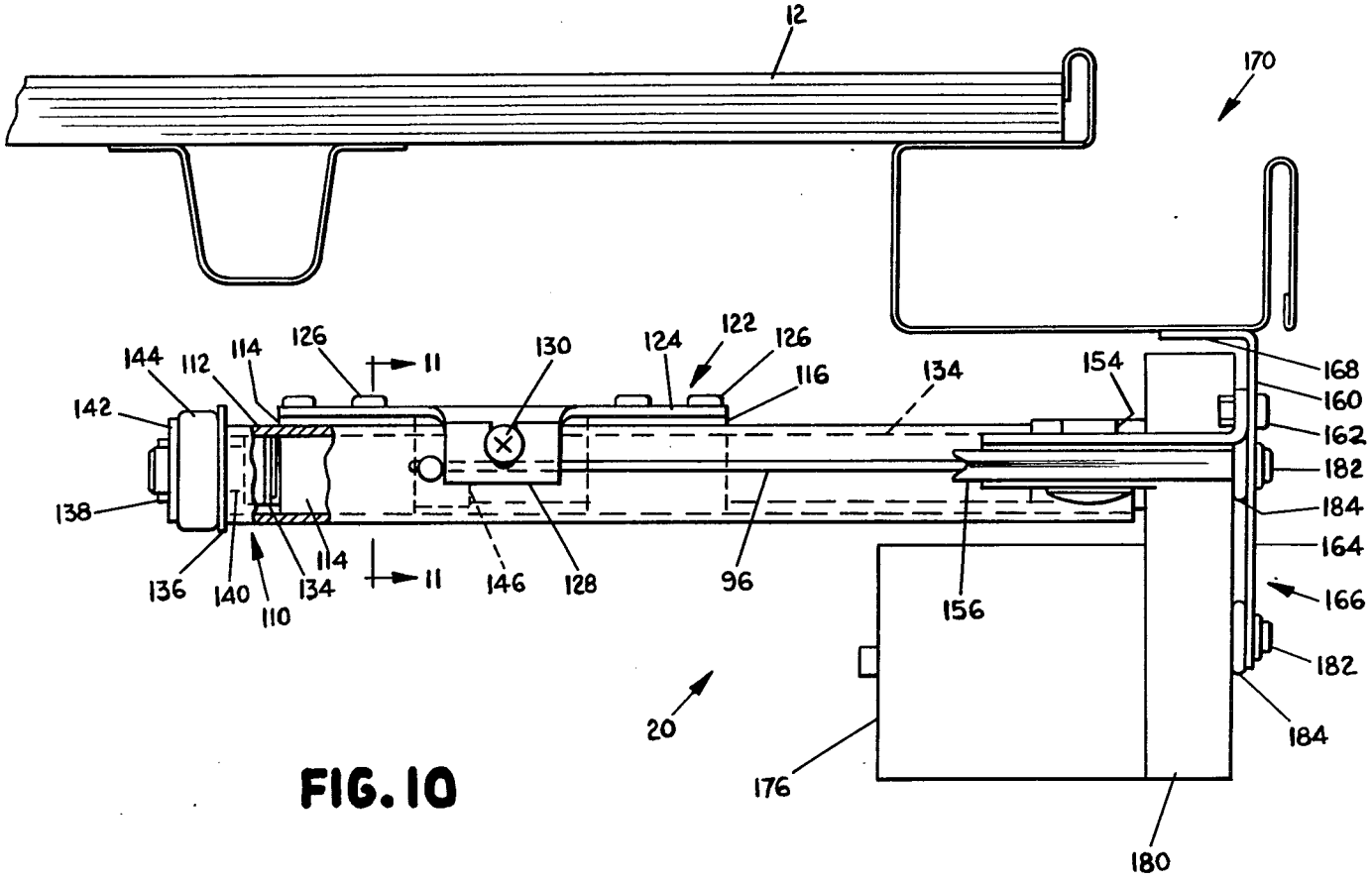
FIG. 10 is a side view of the central drive mechanism taken along lines 10—10 of FIG. 9.

Referring to FIGS. 9, 10 and 11, a pair of pulley mounting assemblies 148 are positioned at the sides of the rear portion of the elongated channel 110. Each of the mounting assemblies 148 includes a vertical section 150 welded or otherwise rigidly secured to the sides of the channel 110. Each mounting assembly 148 also includes a pair of flanges 152 extending outwardly from the sides of channel 110 and forming a horizontally-disposed spacial area therebetween. The flanges 152 each include apertures through which capped axles 154 are received. The axles 154 each rotatably mount a pulley 156. The pulleys 156 engage the cables 96 extending from the left-side and right-side lift mechanisms 16 and 18, respectively.

Each pulley mounting assembly 148 also includes a transverse vertical flange 160. The flanges 160 are secured by nut and bolt assemblies 162 or similar securing means to a vertical portion 164 of a work surface mounting plate 166. The work surface mounting plate 166 includes a horizontally-disposed and forwardly-projecting flange 168 which is bolted or otherwise secured to a wire access raceway 170 as primarily shown in FIG. 10. The wire raceway 170 is also secured by weldment or other suitable connecting means to the work surface 12. The wire raceway 170 can be configured in any of a number of configurations, and provides a channel for running electrical wires and the like.

The central drive mechanism 20 further includes a conventional motor 176. Although not shown in detail in the drawings, the motor 176 is coupled to a rear drive shaft portion 178 of the threaded screw 134 through a conventional gear box assembly 180. The gear box assembly 180 and motor 176 are mounted to the work surface mounting plate by means of screws 182 or similar connecting means. To mechanically isolate vibrational movement of the motor 176 and gear box 180 from the work surface 12, rubber grommets 184 or similar resilient paddings are received on the screws 182 and positioned between the mounting plate 166 and the rear portion of the gear box 180 and motor 176.

In accordance with the foregoing, the motor 176, gear box 180, screw 134 and nut 146 can be characterized as a force generating means. Correspondingly, the slide blocks 114, 116 and yoke 122 can be characterized as a means connected to the cables 96 and to the force generating means to exert forces on the left- and right-side cable mechanisms 16 and 18, respectively, in response to forces exerted by the motor 176, gear box 180, screw 134 and nut 146, so as to selectively raise or lower the work surface 12.

The operation of the height adjustment mechanism comprising the left-side cable mechanism 16, right-side cable mechanism 18 and central drive mechanism 20 will now be described with respect to FIGS. 1–11.

To adjust the height of the work surface 12 relative to ground level and the wall panels 14, the user first activates the motor 176. The motor 176 is a reversible motor whereby the user can selectively choose the direction of rotation. Although not specifically shown in the drawings, the electrical components of the motor 176 can preferably be connected to switches mounted on each side of the work surface 12. In addition, the spacially separated switches should preferably be connected in a series configuration so that the user must simultaneously activate both switches to actuate the height adjustment mechanism. Accordingly, two hands are required to actuate the mechanism and the potential of accidental actuation is substantially decreased.

Assuming that the user wishes to raise the height of the work surface 12, the motor 176 is activated so as to cause rotation of the threaded screw 134 in a direction causing the nut 146 to move axially towards the front shaft portion 140. The nut 146 is prevented from actual rotation by its retainment under the return legs 112 of the channel 110 and thus exerts a pushing force on the forward slide block 114 in an axial direction along the screw 134.

With the forward slide block 114 secured to the central yoke plate 124, the yoke 122 will move in a forward direction above the channel 110. This forward movement of the yoke 122, with the cables 96 secured within the saddles 128, will correspondingly cause the ends of cables 96 to move towards the front portion of channel 110 and the length of the portion of the cables 96 extending between the saddles 128 and the pulleys 156 to increase. During this movement, the rear slide block 116 will tend to maintain alignment of the yoke 122 relative to channel 110.

Referring to the operation of the left-side cable mechanism 16, the forces exerted on the cable 96 by forward movement of the yoke 122 will cause movement in a direction such that the upper pulley 88 will rotate in a counterclockwise direction and the lower pulley 88 will rotate in a clockwise direction as shown in FIG. 4. Correspondingly, with the upper and lower pulleys 88 stationary with respect to each other, the length of the cable 96 between the lower pulley 88 and the hook 98 must shorten. Forces are thereby exerted through cable 96 on the pulleys 88 in a manner so as to exert a lifting force on the extrusion 74. The extrusion 74 will thus move in an upward direction and maintained in a vertically-aligned position by means of the guide wheels 70 mounted to the mounting plate 38. With the extrusion 74 secured to the support casting 48 through lugs 78, and with the support casting 48 mounting the work surface 12, the vertical movement of the extrusion 74 will cause corresponding upward movement of the work surface 12.

To lower the work surface, the user will operate the switches and motor 176 so as to rotate the threaded screw 134 in a direction causing nut 146 to back away from the forward portion of screw 134. Correspondingly, with the tension loading on cables 96, the slide block 114 will move rearward and continue to bear against the nut 146.

Again, with the forward slide block 114 secured to the central yoke plate 124, the yoke 122 will correspondingly move rearwardly. With the cables 96 secured within the saddles 128, the rearward movement of the yoke 122 will allow the ends of cables 96 to move towards the rear portion of channel 110 and the length of the portion of the cables extending between the saddles 128 and the pulleys 156 to shorten.

Referring to FIG. 4, rearward movement of the yoke 122 will cause the cable 96 to move in a direction such that the upper pulley 88 will rotate in a clockwise direction and the lower pulley 88 will rotate in a counterclockwise direction. Correspondingly, with the upper and lower pulleys 88 stationary with respect to each other, the length of the cable 96 between the lower pulley 88 and the hook 98 will increase. This increase will result in a release of the lifting force on the extrusion 74 so that the extrusion 74 is allowed to move in a downward direction. With the extrusion 74 secured to support casting 48 through lugs 78, and with the support casting 48 mounting the work surface 12, the downward movement of the extrusion 74 will cause corresponding downward movement of the work surface 12.

As earlier described, the rear surface 120 of the forward slide block 114 shown in FIG. 9 is rounded so as to essentially form a spherical surface. Correspondingly, the nut 146 includes a front surface having a rounded configuration which substantially mates with the rear surface 120 of the forward slide block 114. In addition, the yoke 122 and forward slide block 114 are sized so as to provide some lateral play within channel 110 relative to screw 134. The rounded surfaces of block 114 and nut 146, and the lateral play accorded block 114, advantageously maintain a relatively straight axial loading on screw 134 and nut 146. This straight axial loading is maintained notwithstanding that the weight forces exerted on the yoke saddles 128 through cables 96 may be unequal. This unequal loading can result, for example, from an unbalanced load on the work surface 12. By maintaining the substantially straight axial loading, shearing or nonaxial forces exerted on the screw 134 and nut 146 are relatively small. Thus, screw 134 and nut 146 need not be constructed of relatively expensive materials.

As also earlier described, the thrust bearing 144 is received on the forward shaft portion 140 of screw 134. By positioning the thrust bearing 144 between the end of the forward shaft portion 140 and the end plate 136 on channel 110, the bearing 144 advantageously takes up the load forces resulting from the weight of work surface 12 exerted on the yoke 122 through cables 96.

A height adjustment mechanism in accordance with the invention can also include various other components. For example, to prevent any potential damage which may result from an overload on the mechanism, limit switches can be mounted to the central drive mechanism 20 to ensure that the motor 176 is shut off in the event that the user attempts to adjust the height of the work surface 12 beyond predetermined limits. Such limit switches are well-known and commercially available, and can be mounted to the central drive mechanism 20 in a manner so that they are activated by movement of the yoke 122 beyond predetermined limits along the screw 134.

In addition, it is also feasible to employ other structure for the central drive mechanism 20. For example, the central drive mechanism 20 could utilize a device such as a "windlass" having a rotatable drum on which the cables 96 are wound and unwound. By winding the cables 96 onto the drum (or a set of drums), the work surface 12 would be raised, with the cables 96 and left-side and right-side cable mechanisms 16 and 18, respectively, operating in the manner previously described herein. The cable mechanisms 16 and 18 would also operate in the manner earlier described herein to lower the work surface 12 when the drum was rotated in a manner so as to release holding forces on the cables 96 and thus "unwind" the cables 96 from the drum.

To drive the windlass drum, an electric motor drive assembly such as a motor connected to the windlass drum through a worm gear reduction arrangement could be employed. The electric motor/worm gear reduction assembly could be utilized in place of the motor 176, gear box assembly 180 and threaded screw 134 previously described herein.

In such an arrangement, the motor and worm gear reduction assembly can be characterized as a force generating means, with the windlass drum characterized as a means connected to the cables 96 for exerting forces on the cable mechanisms 16 and 18 to selectively raise or lower the work surface 12. In addition, other conventional motor and gearing arrangements could also be utilized with the windlass drum.

Furthermore, the principles of the invention are not limited to the other specific structural configurations of the height adjustment mechanism described herein. It will be apparent to those skilled in the art that modifications and variations of the above-described illustrative embodiments of the invention may be effected without departing from the spirit and scope of the novel concepts of the invention.

The embodiments of the invention in which an exclusive property or privilege is claimed are defined as follows:

1. A height adjustment mechanism for automatically adjusting the height of a work surface and comprising a left-side cable lift mechanism, a right-side cable lift mechanism, a central drive mechanism and cable means operatively coupling said left-side and right-side lift mechanisms to said central drive mechanism, and wherein each of said left-side and right-side lift mechanisms comprises:

mounting means for mounting said corresponding cable lift mechanism to a wall panel or a similar supporting surface;

lift support means mounting said work surface and mounted for guided vertical movement relative to said mounting means;

support pulley means secured to said lift support means and engaging said cable means for supporting said work surface; and said central drive mechanism comprises:

central support means for mounting said central drive mechanism to said work surface;

force generating means; and means connected to said cable means and to said force generating means for exerting forces on each of said lift support means in response to forces generated by said force generating means so as to selectively raise or lower said work surface.

2. A height adjustment mechanism in accordance with claim 1 wherein said mounting means comprises:

a hanger clip having projecting means engaging openings in said wall panels; and first antidislodgment means pivotably mounted to said clip and engageable with at least one other opening in said wall panel for preventing dislodgment of said clip when said projecting means engage said wall panel opening.

3. A height adjustment mechanism in accordance with claim 2 wherein said mounting means further comprises a mounting plate removably suspended from said hanger clip and wherein said plate includes a surface bearing against said first antidislodgment means for maintaining said first antidislodgment means in engagement with said other wall panel opening.

4. A height adjustment mechanism in accordance with claim 1 wherein said mounting means comprises:

a hanger clip having projecting means engaging openings in said wall panel;

a mounting plate removably suspended from said hanger clip; and second antidislodgment means pivotally mounted to said mounting plate and engageable with a slot in said hanger clip after suspension of said plate from said clip for preventing dislodgment of said plate.

5. A height adjustment mechanism in accordance with claim 1 wherein said mounting means comprises guide means engaging said lift support means for maintaining vertical alignment thereof during height adjustment of said work surface.

6. A height adjustment mechanism in accordance with claim 1 wherein said mounting means comprises:

a hanger clip having projecting means engaging openings in said wall panel;

a mounting plate having a straight portion, means projecting from said straight portion for suspending said plate from said clip and a angled portion extending laterally from said straight portion; and a support casting mounting said work surface and having a vertical surface mating with said bell-shaped portion to assist in guiding said mounting plate into engagement with said clip.

7. A height adjustment mechanism in accordance with claim 1 wherein said lift support means comprises an extrusion having projection portions forming a trackway; and said mounting means comprises a stationary mounting plate having at least one guide wheel coupled to said plate and engaging said trackway to maintain vertical alignment of said extrusion.

8. A height adjustment mechanism in accordance with claim 1 wherein:

said mounting means comprises a hanger clip removably suspended from said wall panel and a mounting plate removably suspended from said clip;

said lift support means comprises an elongated vertical extrusion and a support casting mounting said work surface and connected to said extrusion;

said lift support pulley means comprises upper and lower pulleys rotatably coupled to said extrusion; and said cable means comprises at least one cable engaging said upper and lower pulleys and secured at one end to said mounting plate.

9. A height adjustment mechanism in accordance with claim 1 and further comprising switch means for manually activating said force generating means, and wherein said switch means are located adjacent to said left-side and right-side cable lift mechanisms so as to require an operator to use two hands for activation.

10. A height adjustment mechanism in accordance with claim 1 and further comprising limit switch means mounted to said central drive mechanism for deactivating said force generating means when said work surface attains predetermined upper or lower heights.

11. A height adjustment mechanism in accordance with claim 1 wherein said force generating means comprises:

an elongated member rotatably coupled to said central support means for rotation about its longitudinal axis;

means for selectively rotating said elongated member about said longitudinal axis; and force translation means axially received on said elongated member for translating rotational forces generated by said elongated member into linear forces along said longitudinal axis; and said means connected to said cable means and to said force generating means comprises a cable securing means connected to said cable means and to said force translation means for exerting forces on each of said lift support means in response to rotation of said elongated member so as to selectively raise or lower said work surface.

12. A height adjustment mechanism in accordance with claim 11 wherein said cable securing means is slidably mounted to said central support means and bears against a front portion of said force translation means so that axial movement of said force translation means in one direction correspondingly moves said cable securing means to exert forces on each of said lift support means through said cable means so as raise said work surface.

13. A height adjustment mechanism in accordance with claim 12 wherein said cable means are connected to said cable securing means in a positional relationship relative to said force translation means so that axial movement of said force translation means in an opposing direction will cause said cable securing means to move in said opposing direction and partially release forces exerted on each of said lift support means through said cable means to lower said work surface.

14. A height adjustment mechanism in accordance with claim 11 wherein:

said force translation means comprises a nut threadably received on said elongated member; and said cable securing means comprises a forward slide block slidable along the axis of said elongated member and having at least one surface bearing against at least one surface of said nut.

15. A height adjustment mechanism in accordance with claim 14 wherein said forward slide block is at least partially laterally pivotable relative to said elongated member, and said one surface of said forward slide block and said one surface of said nut are shaped so as to maintain load-bearing forces exerted on said nut along said longitudinal axis of said elongated member.

16. A height adjustment mechanism in accordance with claim 14 wherein said central support means comprises elongated channel means capturing said nut so as to prevent said nut from rotation in response to rotation of said elongated member.

17. A height adjustment mechanism in accordance with claim 16 wherein:

said forward slide block is slidably secured within said channel means; and said cable securing means further comprises a central yoke plate rigidly connected to said slide block above said channel means and means extending laterally from said plate for securing said cable means.

18. A height adjustment mechanism in accordance with claim 17 wherein said cable securing means further comprises means slidably secured within said channel means rearwardly of said nut for maintaining alignment of said yoke plate relative to said channel means.

19. A height adjustment mechanism in accordance with claim 16 wherein said channel means comprises a forwardly-projecting U-shaped channel having inwardly-turned return legs, and wherein said forward slide block and said nut are captured under said return legs.

20. A height adjustment mechanism in accordance with claim 16 wherein said elongated member extends axially through said channel means and is rotatably coupled to a front portion thereof, and a thrust bearing is received on a front portion of said elongated member to bear loading forces resulting from forces exerted through said cable means.

21. A height adjustment mechanism in accordance with claim 16 and further comprising central pulley means rotatably secured to said channel means for providing engaging support of said cable means.

22. A height adjustment mechanism in accordance with claim 11 and further comprising resilient means mounted to said central support means for isolating vibratory motion of said means for rotating said elongated member from said work surface.

23. A height adjustment mechanism in accordance with claim 11 wherein:

said central support means comprises a forwardly-projecting elongated channel located below said work surface, wherein said elongated member extends axially therethrough;

said cable securing means comprises a forward slide block received in said channel and having a rear surface bearing against a surface of said force translation means; and said cable securing means further comprises a yoke secured to said slide block above said channel and having laterally-projecting saddles securing said cable means.

24. A height adjustment mechanism in accordance with claim 11 wherein said cable securing means is at least partially laterally pivotal relative to said elongated member and is operatively connected to said force translation means so as to maintain load-bearing forces exerted on said nut along said longitudinal axis of said elongated member.

25. A height adjustment mechanism in accordance with claim 1 and further comprising thrust bearing means received on a front portion of said elongated member and coupled to a front portion of said central support means for bearing loading forces resulting from said forces exerted through said cable means.

26. A height adjustment mechanism in accordance with claim 1 wherein said force generating means comprises motor means mounted to said central support means and worm gear reduction means connected to said motor means for generating forces; and said means connected to said cable means and to said force generating means comprises a windlass drum rotatably coupled to said force generating means, wherein said cable means are wound onto said drum.

* * * * *